US006114080A

United States Patent [19]

Texter et al.

[11] Patent Number: 6,114,080

[45] **Date of Patent: *Sep. 5, 2000**

[54] CHROMOGENIC BLACK AND WHITE IMAGING FOR HEAT IMAGE SEPARATION

[75] Inventors: John Texter; Roland George Willis, both of Rochester, N.Y.

[73] Assignee: Eastman Kodak Company, Rochester, N.Y.

[ * ] Notice: This patent is subject to a terminal disclaimer.

[21] Appl. No.: 08/170,601

[22] Filed: Dec. 21, 1993

[51] Int. Cl.[7] ..... G03C 8/40; G03C 8/20; G03C 8/12

[52] U.S. Cl. ..... 430/203; 430/218; 430/226; 430/402; 430/549

[58] Field of Search ..... 430/203, 226, 430/402, 565, 549, 218

[56] References Cited

U.S. PATENT DOCUMENTS

| | | | |
|---|---|---|---|
| H456 | 4/1988 | Hara et al. | 430/203 |
| 2,592,514 | 4/1952 | Harsh | 430/549 |
| 3,635,707 | 1/1972 | Cole | 430/226 |
| 4,348,474 | 9/1982 | Scheerer et al. | 430/549 |
| 4,563,412 | 1/1986 | King et al. | 430/222 |
| 4,816,372 | 3/1989 | Schenk et al. | 430/203 |
| 4,840,885 | 6/1989 | Peters et al. | 430/203 |
| 4,877,722 | 10/1989 | Peters et al. | 430/203 |
| 5,164,280 | 11/1992 | Texter et al. | 430/203 |
| 5,270,145 | 12/1993 | Willis et al. | 430/203 |
| 5,288,745 | 2/1994 | Texter et al. | 430/214 |
| 5,362,616 | 11/1994 | Edwards et al. | 430/402 |

FOREIGN PATENT DOCUMENTS

| | | | |
|---|---|---|---|
| 473751 | 3/1992 | Japan | 430/203 |
| WO93/12465 | 6/1993 | WIPO . | |

*Primary Examiner*—Richard L. Schilling
*Attorney, Agent, or Firm*—Paul A. Leipold

[57] ABSTRACT

An aqueous developable photographic element for forming neutral images comprising balanced cyan, magenta, and yellow heat-diffusible-dye-forming couplers in one or more image forming layers, and further comprising sensitized silver halide, a thermal solvent for nonaqueous, thermal dye-diffusion transfer, and hydrophilic binder, each independently in one or more image forming layers, an integral receiver layer for dye mordanting during nonaqueous, thermal dye-diffusion transfer, and one and only one dimensionally stable support, where said receiver layer is intermediate said support and image forming layers, and wherein said receiver layer and said support may be mechanically separated from said image forming layers by opposing forces is disclosed. Processes for forming a neutral photographic image using such elements and using elements that are similar, but lacking an integral receiving layer, are also disclosed.

24 Claims, No Drawings

CHROMOGENIC BLACK AND WHITE IMAGING FOR HEAT IMAGE SEPARATION

RELATED APPLICATIONS

This application is related to commonly assigned U.S. application Ser. No. 07/804,877, *Heat Image Separation Systems*, of Willis and Texter filed Dec. 6, 1991, now U.S. Pat. No. 5,270,145, Ser. No. 07/804,868, *Thermal Solvents for Dye Diffusion in Image Separation Systems*, of Bailey et al. filed Dec. 6, 1991, Ser. No. 08/049,048, *Thermal Solvents for Heat Image Separation Processes*, of Bailey et al. filed Apr. 16, 1993, now U.S. Pat. No. 5,352,561, Ser. No. 07/927,691, *Polymeric Couplers for Heat Image Separation Systems*, of Texter et al. filed Aug. 10, 1992, now U.S. Pat. No. 5,354,642, Ser. No. 07/993,580, *Dye-Releasing Couplers for Heat Image Separation*, of Texter et al. filed Dec. 21, 1992, now U.S. Pat. No. 5,356,750, Ser. No. 08/008,914, after Ser. No. 08/008,914, Aqueous Developable Dye Diffusion Transfer Elements Containing *Solid Particle Thermal Solvent Dispersions*, now U.S. Pat. No. 5,360,695, of Texter filed Jan. 26, 1993, Ser. No. 08/073,821, *Hydrogen Bond Donating/Accepting Thermal Solvents for Image Separation Systems*, of Bailey et al. filed Jun. 8, 1993, and Ser. No. 07/981,566, *Chromogenic Black-and-White Photographic Imaging Systems*, of Edwards et al. filed Nov. 25, 1992, now U.S. Pat. No. 5,362,616.

FIELD OF THE INVENTION

This invention relates to the formulation of a diffusion transfer photographic system which produces black and white images using a combination of cyan, magenta, and yellow dyes formed by the reaction of oxidized primary amine color developing agent with color couplers. These dyes, when subjected to a non-aqueous thermal diffusion transfer step, form a neutral image in a dye mordanting layer.

BACKGROUND OF THE INVENTION

In conventional "wet" silver halide based color photographic processing systems, an imagewise exposed photographic element is processed in a color developer solution. The developing agent in this developer solution reduces the exposed silver halide of the photographic element to metallic silver, and the resulting oxidized color developing agent reacts with incorporated dye-forming couplers to yield dye images corresponding to the imagewise exposure. Since the metallic silver present desaturates the pure colors of the image dyes, it is desirable to remove the silver from the image area. Silver is conventionally separated from dye image areas by a process of bleaching the silver, often to silver halide, and removing the silver halide by using a fixing bath, or alternatively by incorporating fixing agents into the bleaching bath, to provide a bleach-fix solution.

Bleach-fix solutions commonly contain iron, ammonium, ethylenediaminetetraacetic acid, thiosulfate, and seasoned silver. These components of "wet" silver halide color development processing are the source of much of the pollution from photoprocessing.

Black-and-white images formed in a photographic process are generally produced by developing silver halide in a black-and-white developer to form a silver image. A black-and-white developer, such as hydroquinone, is commonly used to reduce the exposed silver halide to silver metal. The undeveloped silver halide is removed from the print by "fixing" with aqueous sodium thiosulfate. The silver metal remaining in the print represents the image.

In the photographic industry, a photofinisher who wishes to produce both black-and-white and color pictures or prints must have separate processing systems; one for color and one for black-and-white, as the two systems are not compatible. It would, therefore, be advantageous for the photofinisher to have one process capable of producing either black-and-white or color materials.

Conventional Chromogenic Black and White Imaging

Schneider, in U.S. Pat. No. 2,186,736, discloses the use of several color components in one layer for a black-and-white image formation.

Harsh, in U.S. Pat. No. 2,592,514, discloses a color film in which couplers forming more than one color are present in the same layer of the color film.

Scheerer, in U.S. Pat. No. 4,348,474, discloses a system wherein black-and-white images are formed by the use of one emulsion that is treated with three sensitizing dyes.

There have been commercialized products that have formed black-and-white images by the use of pan sensitized emulsions which contain three spectral sensitizing dyes, color dye forming couplers and one emulsion. These pan-sensitive emulsions are sometimes coated in a fast and a slow layer to form images after exposure and development of the couplers. While the above products are somewhat successful, they do not achieve a neutral image. Additionally, the tone reproduction of such materials is severely limited by the contrast range of the emulsion.

Edwards et al., in U.S. application Ser. No. 07/981,566 filed Nov. 25, 1992, published as European Application 0 572 629 disclose chromogenic black and white photographic imaging systems comprising the formation of balanced cyan, magenta, and yellow coupler and emulsion mixes. These systems comprise at least one layer in which silver halide emulsion has been sensitized to blue light or to green light. The grains of silver halide are each sensitized to only a single color, although grains sensitive to different colors may be blended in one layer with the neutrally balanced couplers. Regardless of the color sensitivity of the silver halide layer that contains silver, this layer contains a mixture of cyan, magenta, and yellow dye-forming couplers. In order to obtain a black and white image having a tone scale such as observed by the human eye in a scene, preferred embodiments contain ratios of red sensitive emulsion to green sensitive emulsion to blue sensitive emulsion of about 2:3:1.

Diffusion Transfer Chromogenic Black and White Imaging

King and Stroud, in U.S. Pat. No. 4,563,412, disclose black image dye-providing materials and processes utilizing same, wherein these materials and processes utilize diffusion transfer methods of the instant color photographic variety.

Heat Image Separation Systems

Willis and Texter, in U.S. application Ser. No. 07/804,877, *Heat Image Separation Systems*, filed Dec. 6, 1991, now U.S. Pat. No. 5,270,145, disclose a process for forming a dye image including the steps of: (a) exposing a photographic element comprising a light sensitive silver halide emulsion layer containing a color coupler compound capable of forming a heat transferable dye upon development; (b) developing the exposed element resulting from step (a) with a color developer solution to form a heat transferable dye image; (c) heating the exposed, developed element resulting from step (b) to thereby transfer the dye image from the emulsion layer to a dye receiving layer which is part of the photographic element or part of a separate dye receiving element brought into contact with the photographic element; and (d) separating the emulsion layer from the dye receiving layer containing the transferred dye image; wherein the color coupler compound is of the following formula (I)

COUP-B (I)

wherein COUP represents a coupler moiety capable for forming a heat transferable dye upon reaction of the coupler compound with an oxidized product of the developing solution of step (b); and B is hydrogen or a coupling-off group which is separated from COUP upon reaction of the coupler compound with an oxidized product of the developing solution of step (b). The process combines "wet" development with conventional developing solutions and "dry" separation of the developed image from the emulsion layer by heat transfer.

Bailey et al. in U.S. application Ser. No. 07/804,868, *Thermal Solvents for Dye Diffusion in Image Separation Systems*, filed Dec. 6, 1991, disclose a photographic chromogenic and substantially dry dye-diffusion-transfer element, wherein said element is activated by heat and comprises contacting dye-receiver and dye-donor layers and further comprises a layer which contains a thermal solvent according to formula (II)

(II)

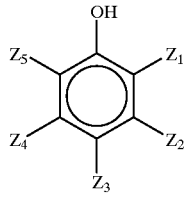

wherein $Z_1$, $Z_2$, $Z_3$, $Z_4$, and $Z_5$ are substituents, the Hammet sigma parameters of $Z_2$, $Z_3$, and $Z_4$ sum to at least −0.28 and less than 1.53;

the calculated logP for II is greater than 3 and less than 10. This disclosure is incorporated herein by reference in its entirety for all that it discloses.

Komamura and Nimura, in Kokai Pat. application No. HEI 4[1992]-73751, disclose a method for forming images, characterized by the fact that a photographic photosensitive material having, on a support, a photosensitive layer containing a photosensitive silver halide, dye-forming material, binder, and a thermal solvent, is exposed with an image, and after developing with a liquid, the image-forming material and photosensitive layer surface of the aforementioned photographic photosensitive material is bonded and heated, with all or part of the dye formed as an image on said image-forming material being transferred to the image-forming material. This disclosure is incorporated herein by reference in its entirety for all that it discloses.

Bailey et al. in U.S. application Ser. No. 08/073,821, *Hydrogen Bond Donating/Accepting Thermal Solvents for Image Separation Systems*, filed Jun. 8, 1993, disclose an aqueous-developable chromogenic photographic heat-transferable non-aqueous dye-diffusion-transfer photographic element, wherein this element comprises radiation sensitive silver halide, a dye-providing compound that forms or releases a heat-transferable image dye upon reaction of said compound with the oxidation product of a primary amine developing agent, a hydrophilic binder, and a thermal solvent for facilitating non-aqueous diffusion transfer according to formula (III)

(III)

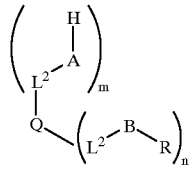

wherein

AH is a hydrogen bond donating group with an aqueous $pK_a$ value for proton loss of greater than 6;

$L^1$ and $L^2$ are each independently divalent linking groups consisting of groups of 1 to 12 atoms or are independently absent;

m is 1, 2, or 3;

Q comprises a group of 2 to 15 carbon atoms selected from the group consisting of aromatic rings, alkyl rings, or ring-chain combinations, optionally substituted with substituents, Z, consisting of alkyl groups or halogens;

B is a hydrogen bond accepting group with an aqueous $pK_a$ value for proton loss of greater than 6;

n is 1 or 2;

the groups AH and B cannot hydrogen bond to form a ring of either 5 or 6 atoms;

R is an alkyl, aryl and alkylaryl group of from 1 to 18 carbon atoms;

the calculated log of the octanol/water partition coefficient (clogP) is greater than 3 and less than 10. This disclosure is incorporated herein by reference in its entirety for all that it discloses.

Texter et al. in U.S. application Ser. No. 07/927,691, *Polymeric Couplers for Heat Image Separation Systems*, filed Aug. 10, 1992, disclose a process for forming a dye image including the steps of:

exposing a photographic element comprising a support bearing a light sensitive silver halide emulsion layer containing a polymeric color coupler compound capable of forming a heat transferable dye upon development, wherein the polymeric color coupler compound is of the formula (IV)

COUP-L-B (IV)

wherein COUP represents a coupler moiety capable of forming a heat transferable dye upon reaction of the moiety with an oxidation product of a color developer; L is a divalent linking group which is separated from COUP upon reaction of the coupler moiety with said oxidation product of a color developer; and B represents the polymeric backbone;

developing said exposed element with a color developer solution to form a heat transferable dye image;

heating said exposed, developed element to thereby transfer the dye image from the emulsion layer to a dye receiving layer, where said receiving layer is part of the photographic element or part of a separate dye receiving element brought into contact with the photographic element; and separating the emulsion layer from the dye receiving layer containing the transferred dye image. This disclosure is incorporated herein by reference in its entirety for all that it discloses.

Texter et al. in U.S. application Ser. No. 07/993,580, *Dye-Releasing Couplers for Heat Image Separation*, filed Dec. 21, 1992, disclose an aqueous-developable photographic color diffusion transfer element comprising a single dimensionally stable support and one or more layers comprising radiation sensitive silver halide, thermal solvent for facilitating the thermal diffusion of dyes through a hydrophilic binder, a dye-releasing coupler, and hydrophilic binder, wherein said dye is heat diffusible in said binder and thermal solvent, and wherein said dye-releasing coupler is of the formula (V)

$$\text{Cp-L-Dye} \qquad \text{(V)}$$

where

Cp is a cyan dye forming radical, magenta dye forming radical, yellow dye forming radical, black dye forming radical, or colorless product forming radical, said Cp being substituted in the coupling position with a divalent linking group, L;

Dye is a dye radical exhibiting selective absorption in the visible spectrum; and where said -L-Dye group couples off upon reaction of said coupler radical with the oxidation product of a primary amine developing agent. This disclosure is incorporated herein by reference in its entirety for all that it discloses.

Problem to be Solved by the Invention

There is a need for high quality black and white photographic products that are suitable for development in color imaging systems. There is a need to produce black and white prints from color negatives that better reproduce the tone scale of the negative and of the originating scene. Further, there is a desire that silver be recovered from the photographic print used to form the black and white images rather than being a part of the image and, therefore, not recoverable. There also is a need to decrease polluting effluent from photoprocessing and photofinishing laboratories. There is a need to provide increased image dye stability in chromogenic black and white and in chromogenic neutral print materials.

SUMMARY OF THE INVENTION

An object of the invention is to provide black and white images that are developable in color processes. Another object of the invention is to provide black and white images of improved tone scale by the use of color couplers and conventional "wet" color development. An additional object of the invention is to provide a photographic processing system which reduces the amount of waste processing solution effluent generated by the overall processing system, while retaining the benefits of image quality and industry compatibility that are derived from "wet" development with conventional color developing solutions. A further object of the invention is to provide a chromogenically based black and white image wherein the image dyes are protectively encased in a polymeric matrix.

The invention is generally accomplished by providing an aqueous developable photographic element for forming neutral images comprising balanced cyan, magenta, and yellow heat-diffusible-dye-forming couplers in one or more image forming layers, and further comprising sensitized silver halide, a thermal solvent for nonaqueous, thermal dye-diffusion transfer, and hydrophilic binder, each independently in one or more image forming layers, an integral receiver layer for dye mordanting during nonaqueous, thermal dye-diffusion transfer, and one and only one dimensionally stable support, where said receiver layer is intermediate said support and image forming layers, and wherein said receiver layer and said support may be mechanically separated from said image forming layers by opposing forces.

In a preferred embodiment a chromogenic diffusion transfer process for forming a neutral photographic image is provided comprising the steps of:

providing an aqueous developable photographic element for forming neutral images comprising balanced cyan, magenta, and yellow heat-diffusible-dye-forming couplers in one or more image forming layers, and further comprising sensitized silver halide, a thermal solvent for nonaqueous, thermal dye-diffusion transfer, and hydrophilic binder, each independently in one or more image forming layers, an integral receiver layer for dye mordanting during nonaqueous, thermal dye-diffusion transfer, and one and only one dimensionally stable support, where said receiver layer is intermediate said support and image forming layers, and wherein said receiver layer and said support may be mechanically separated from said image forming layers by opposing forces;

exposing said element to actinic radiation;

processing said element by contacting said element to an external aqueous bath containing compounds selected from the group consisting essentially of color developer compounds of the primary amine type, compounds which activate the release of incorporated color developers, and compounds which activate development by incorporated developers;

washing said element;

drying said element to remove imbibed water;

heating said element to effect dye-diffusion transfer to an image receiving layer; and separating said integral receiver layer from said image forming layers.

In another preferred embodiment, a chromogenic diffusion transfer process for forming a neutral photographic image is provided comprising the steps of:

providing an aqueous developable photographic element for forming neutral images comprising balanced cyan, magenta, and yellow heat-diffusible-dye-forming couplers in one or more image forming layers, and further comprising sensitized silver halide, a thermal solvent for nonaqueous, thermal dye-diffusion transfer, and hydrophilic binder, each of said thermal solvent and hydrophilic binder is independently in one or more image forming layers, and one and only one support;

exposing said element to actinic radiation;

processing said element by contacting said element to an external aqueous bath containing compounds selected from the group consisting essentially of color developer compounds of the primary amine type, compounds which activate the release of incorporated color developers, and compounds which activate development by incorporated developers;

washing said element;

drying said element to remove imbibed water;

contacting said image forming layers of said photographic element with a dry image receiving element comprising an image receiving layer for dye mordanting during nonaqueous, thermal dye-diffusion transfer such that said image forming and image receiving layers are in reactive association with respect to thermally activated dye diffusion transfer, and one and only one dimensionally stable support;

heating said contacting photographic and receiving elements to effect dye-diffusion transfer to said image receiving layer; and separating said receiving element from said aqueous developable photographic element.

ADVANTAGEOUS EFFECT OF THE INVENTION

The invention has numerous advantages over the prior art. By the formation of an accurate black and white reproduction of a color exposure, the photographic products of the invention eliminate the need for a separate processing system in order to form black and white photographs. The black and white photographic system of the invention further allows the recovery of substantially all of the silver from a black and white photographic image. The present invention further offers the opportunity to recover couplers that (1) have not been converted to image dye during "wet" aqueous development and (2) have not thermally transferred to a dye-mordanting receiver element. In embodiments of the present invention that omit bleaching and fixing steps, a further cost benefit of the elimination of bleaching and fixing chemistry is obtained. Concomitantly, polluting effluent from the disposal of spent bleaching and fixing solutions is eliminated. Another advantage of the system is that the reproduction of lightness ratios and tone is more accurate than any other system using color couplers to form black and white images. Another advantage is that if the lightness and tone of the black and white image are desired to be changed, this can be accomplished by the use of conventional color filters during printing of the negative. Embodiments of the present invention utilizing separate dye-mordanting receiver elements offer the advantage that hue adjustments to the final print may be made by selecting receiver elements having different dye-diffusion-transfer permeability/partitioning properties obtained by chemical variations in formulating the receiver element. A photographic print formed in accordance with the invention will respond to changes in filtration of colored light during printing in a manner that allows ready adjustment of tone and lightness. This advantage is not available in other black and white photographic systems where pan or ortho sensitive emulsion systems are employed. Additionally, contrast variations may be achieved simply by varying the heating temperature/time regimen during thermal dye transfer, while aqueously developing test prints identically for fixed time intervals in readily accessible industrially standardized color development processes. A significant cost advantage to the photofinisher is offered by the present invention because it can be incorporated in most of the extant photofinishing machines and processes with only minor additional capital expenditure.

DETAILED DESCRIPTION OF THE INVENTION

A suitable integral layer structure for elements of the present invention generally consists of a (1) dimensionally stable support of transparent or reflection material, (2) a receiver layer to which the diffusible dyes migrate under thermal activation, (3) optionally a stripping layer, (4) one or more imaging layer(s) (comprising silver halide and diffusible-dye releasing couplers) in which the light image is captured and amplified during conventional aqueous color development, and (5) a protective overcoat. This structure is illustrated in Table 1. Stripping layers in such structures may be omitted. The imaging layer(s) and overcoat layer comprise a "donor" element. The support and dye-receiving layer comprises a "receiving" element.

TABLE 1

| Layer Structure for Integral Element |
|---|
| Protective Overcoat Layer |
| Imaging Layer(s) |
| Stripping Layer |
| Dye Receiving Layer(s) |
| Support |

Another suitable structure for elements of the present invention is the non-integral structure illustrated in Table 2, where separate donor and receiver elements are shown. The donor element comprises a support, one or more imaging layers, and optionally a protective overcoat layer. Such a donor element, subsequent to aqueous development and drying, is laminated to a suitable receiver element and heated to effect image dye transfer. Suitable receiver elements generally comprise a support and a dye-receiving layer or layers.

TABLE 2

| Layer Structure for Laminate Eleinent of the Present Invention | |
|---|---|
| Receiver Support | |
| Dye-Receiving Layer(s) | |
| ⬆ Receiver Element ⬆ | ⇓ Donor Element ⇓ |
| Protective Overcoat Layer | |
| Diffusible-Dye Forming (Imaging) Layer(s) | |
| Donor Support | |

In the sequel and claims, the term "coupler" is meant to comprehend couplers and polymeric couplers according to formulae (I), (IV), and (V), whether these particular species are dye-forming or dye-releasing. The term "dye-forming" is meant to comprehend "dye-releasing". The term "thermal solvent" when used in the present invention and claims is meant to comprehend any water immiscible organic compound that facilitates image dye-diffusion transfer under non-aqueous heating conditions. This term does not refer to relatively small and highly polar organic compounds, such as substituted ureas, triazoles, etc., that are also known in the photographic trade as thermal solvents and heat solvents and function primarily to facilitate the heat development of silver halide and silver organic salts. Particularly preferred thermal solvents in the present invention are given by formulae (II) and (III) because of their demonstrated efficacy in heat image separation systems.

The terms "in association" or "associated with" are intended to mean that materials can be in either the same or different layers, so long as the materials are accessible to one another. This accessibility may be by aqueous molecular diffusion or by non-aqueous molecular diffusion.

The phrase "balanced cyan, magenta, and yellow dye-forming couplers" means that the couplers are balanced to provide a generally neutral image after dye-diffusion transfer. This "balancing" comprehends selection according to thermal dye transfer criteria of diffusion length, partitioning, and relative coupler amounts in particular layers for given processing and heating sequences (time, temperature, pressure, etc.), and in particular comprehends the use of transfer coefficients as discussed below. Balancing is done in order to achieve a desired hue or tone in the final dye image as viewed, and in general may differ from the hue and tone of the dye image as initially formed during aqueous development. Effects of dye-diffusion transfer are considered explicitly in this balancing, given that dyes varying in structure and in diffusion distance may transfer to a receiver layer with varying efficiency.

This neutrally balanced transferred-image would preferably for most uses be black and white. It is also possible in accordance with the invention technique to balance to give a sepia tone or slightly bluish tone to the image but still have a generally neutral image. It is possible to impart any particular tone, in the present invention, necessary for any particular trade application, while still providing a generally neutral transferred-image.

To make a black and white transferred-image using a mixture of dyes formed from couplers, it is necessary to balance the ratio of the couplers in the imaging layer so that after exposure, color development, and dye-diffusion transfer, the resultant transferred-image is neutral and lacks any specific color bias. There may, however, be photographic market requirements whereby the color of the desired reproduction may not be neutral. For example, to accurately reproduce the tone of a "sepia-toned" print, it would be necessary to alter the ratios of the couplers in the dispersion or the ratios of the dispersions in the emulsion layer in such a way that the preferred "sepia-toned" color balance is obtained. This process can be easily done using simple mathematical models and simple empirical experimentation. Also, many "black and white papers" based upon silver halide systems which are presently in the market place are known not to produce a neutral image. Depending upon the formulation of the silver halide material and the nature of the development process, a wide variety of shades of green, red, yellow or brown can be produced. Each having its own unique characteristic color and photographic application.

An embodiment of the invention utilizes an oil-in-water dispersion containing a mixture of cyan, magenta, and yellow dye-forming couplers. Also, separate dispersions containing cyan, magenta and yellow dye forming couplers can be used. These dispersions may equivalently or with advantage be replaced with polymeric couplers or coupler latexes, and these polymeric materials may incorporate mixtures of cyan, magenta, and yellow dye-releasing moieties. These couplers may independently be selected from any of the formulae (I), (IV), and (V). In addition, other dispersion addenda such as coupler solvent, auxiliary coupler solvent and/or dye stabilizers can be added. Dispersion addenda such as latex polymers or hydrophobic polymers may also be added. The aqueous phase of the dispersion is composed of gelatin, a surfactant, and water. The composition of the oil phase portion of the dispersion or the balance of cyan, magenta, and yellow dye-releasing moieties in a polymeric coupler is adjusted so that when processed in a color developing bath, a neutral image is formed whose density varies only in proportion to the amount of silver developed in the process. In the instance where separate coupler dispersions or latexes are used, the appropriate ratios of each dispersion and latex are added to the layer or layers so that after exposure and development a neutral image is formed.

Once prepared, the coupler dispersion may in one embodiment be coated in a multilayer format much like that used in conventional color film or paper. There are two major differences, however; the first difference is that the same neutral dye-forming coupler dispersion is coated in each emulsion containing layer. Thus, regardless of whether the element is exposed to red, green, or blue light, a neutral image is formed during color development in proportion to the amount of silver development. After color development, the developed and undeveloped silver can be removed from the element by bleaching and fixing, or more simply, blixing (bleach-fixing). In preferred embodiments of the present invention, bleaching and fixing steps are omitted to reduce polluting effluent. When bleaching and fixing steps are omitted, a thermal dye-diffusion transfer step is applied to transfer the neutral dye image to a dye-mordanting receiver layer, thereby separating the silver and chromogenic dye images. When bleaching and fixing steps are retained in the use of the elements and processes of the present invention, advantageous image-dye encasement in receiver layer polymers can be obtained with improved dye hue and often with improved dye stability. Improved hues are obtained because of the molecular dispersion of the thermally transferred dyes in the receiving layer polymer or polymers.

The ratios of sensitized silver halide in the element, in a preferred embodiment, may advantageously be adjusted so that the lightness of the object being reproduced in the original scene is more accurately reproduced. This effect is obtained by coating the spectrally sensitized silver halide layers in amounts which approximately correspond to the eye's relative sensitivity to light, as described by Edwards et al. in copending, commonly assigned U.S. application Ser. No. 07/981,566, filed Nov. 25, 1992, now U.S. Pat. No. 5,362,616, and incorporated herein by reference for all that it discloses. It is generally agreed that the eye's response to red, green and blue light is in the ratio of about 2:3:1. Higher numbers indicate greater sensitivity. Therefore, in the invention element, the ratios of the amount of red sensitive emulsion to the amount of green sensitive emulsion to the amount of blue sensitive emulsion is preferred to be about $2T_B/T_R:3T_B/T_G:1$, where $T_R$, $T_G$, and $T_B$, respectively, denote the average dye-diffusion transfer coefficients for cyan, magenta, and yellow image dye from the donor image-forming layer or layers to the dye image receiving layer or layers. These average dye-diffusion transfer coefficients denote the efficiency of dye-diffusion transfer of formed dye to the dye receiving layer or layers, and are described in greater detail below. However, this eye response ratio can be adjusted to any ratio depending upon the needs and requirements of the photographic system. For example, films designed for X-ray applications which are currently coated on a blue support may preferably be formulated to enhance the visual process of contrast discrimination by using ratios of $2T_B/T_R:2T_B/T_G:1$ or $3T_B/T_R:2T_B/T_G:1$.

Since thermally activated dye-diffusion transfer to a receiver element is an important intrinsic component of the use of the elements of the present invention and of the processes of the present invention, physical chemical account must be taken of this diffusion in formulating the amount and distribution of the various dye-forming couplers in the invention elements. In order to obtain a neutral dye image or a dye image having a particular off-neutral tint, such as a sepia toned tint, in the receiver layer, account must be taken of the dye transfer coefficients that obtain for the dyes of interest upon transfer from the imaging layer of interest to the receiving layer under a particular formulation of the element, development process, and thermal heating regiment in effecting dye-transfer. Because of diverse differences in the interactions of different dyes with binders in the element and with the polymers of the receiving layer, different dyes have different effective permeabilities. In general, therefore, obtaining a neutral image in the receiving layer necessitates generating a non-neutral image in the imaging layer or layers. This poses a simple linear scaling problem that must be refined by experimentation or simple models when designing to obtain an element or process of the invention to obtain a particular neutral or off-neutral tone.

We define the transfer coefficient $T_{ijkl}$ as relating the density of dye j obtained in the receiver from imaging layer i (denoting distance to receiver, binder types and levels, receiver polymers, thermal solvent types, levels, and distributions, etc.) when developed according to process k (eg., developer type, developer, stop, wash processing sequence) and heated according to regimen 1 (eg., time, temperature, pressure conditions), $D_{ijkl,}$ to the density of dye j generated in imaging layer i during the process k, $G_{ijk}$:

$$D_{ijkl}=T_{ijkl}\times G_{ijk} \quad \text{Eqn. (1)}$$

These transfer coefficients provide practical guides and means by which to design formulations and processes by which to adequately "balance" the placement, relative amount, and distribution of cyan, magenta, and yellow dye-forming couplers. It is particularly advantageous that these transfer coefficients derive from a well established and broadly understood linear systems theory to facilitate design and formulation. The combination of this balancing, according to the above described transfer coefficient relation of Equation (1), and the utilization of particular ratios of red, green, and blue sensitized emulsions according to the above discussed eye response or according to other enhanced visual discrimination criteria, is defined herein to denote "diffusion-transfer-convoluted eye-response". A typical result of using such a diffusion-transfer-convoluted eye-response design in elements and processes of the invention having multiple imaging layers, is that the coupler dispersion formulations in different layers will be "balanced" differently, according to the transfer coefficient criteria discussed above. The transfer coefficients $T_R$, $T_G$, and $T_B$, discussed previously, are precisely defined according to the following relations derived from Equation (1) and exemplified for the case of cyan dye transfer:

$$T_R=D_R/G_R \quad \text{Eqn. (2)}$$

where $$D_R=\Sigma_{ijkl}(T_{ijkl}\times G_{ijk})/(\Sigma_{ijk}G_{ijk}) \quad \text{Eqn. (3)}$$

and the summations are over the j cyan dye or dyes formed in the donor layer or layers, and over the i imaging layer or layers in which cyan dye is formed, for the kth development process and for the lth heating regimen. The dependence of $T_R$ on the development process (selection of color developer, for example, will influence the diffusibility of the resulting dyes) and on the heating regimen for dye-diffusion transfer is implicit. Similar relations define $T_G$ and $T_B$.

In another embodiment of the invention, the oil in water dispersion containing a mixture of cyan, magenta, and yellow dye-forming couplers is coated in a layer that contains silver halide grains sensitized to more than one color. In this embodiment the silver halide grains are a mixture of grains sensitized to be sensitive to different light colors. Preferably, the silver halide emulsion contains blue sensitized, green sensitized, and red sensitized silver halide grains. An element may only contain the blue sensitized and green sensitized silver halide grains to form an ortho sensitized element. In certain applications, particularly in the graphic arts, it is preferred to use spectrally sensitized silver halide sensitized to a single region of the visible or near infrared region of the spectrum. This is particularly the case when using the elements and processes of the present invention with laser writing exposure devices and with materials that may be handled in daylight before and during exposure.

Among the advantages of the present processes of the invention is the advantage that contrast may be simply modified with the use of various color filters during the exposing step or steps. A further novel advantage provided by the processes of the present invention is that contrast may be modified and controlled post development by providing variations in the temperature-time profile of the heating step during thermal dye-diffusion transfer. By suitably varying the heating temperature/time profile, identically exposed and aqueously developed elements of the present invention may be used to obtain prints of varying contrast by varying the temperature during the dye-diffusion transfer step. Decreasing temperature will generally provide lower contrast in the diffusion transferred image. Alternatively, such contrast variations can be obtained by varying the temporal duration of the heating in the dye-diffusion transfer step. Decreasing the heating time will generally provide a decrease in contrast. Particular transfer coefficients $T_{ijkl}$, as discussed above, may be determined by straightforward experimentation to determine the heating regimen l needed to afford the contrast desired from image $G_{ijk}$ produced in the aqueous development steps.

The invention may be performed with the materials conventionally utilized in color papers. As known, such papers comprise couplers for forming yellow, cyan, and magenta dyes. It is most common to use predominantly silver chloride emulsions with color paper, as they are suitable for fast processing. It should be apparent that other photographic systems may require the use of emulsions other than silver chloride. Such systems may in fact require silver chlorobromide, silver bromide, silver bromoiodide or silver chlorobromoiodide. The emulsions are sensitized to light in the wavelength to be absorbed by the particular layer where they are present. For instance, silver halide grains in the yellow layer will be most sensitive to blue light, and silver halide grains in the magenta layer will be most sensitive to green light. The use of sensitizing dyes to provide such emulsions is well known. Reference is made to *Research Disclosure* #308119, published December, 1989 for a description of emulsion formation, sensitizing dyes, antifoggant and stabilizers, couplers, hardeners, coating aids, and other conventional materials for use in silver halide image formation. The invention is considered to be able to be practiced with any of the known materials for use in color silver halide photography. Further, it is anticipated that the technique will be satisfactory for use with future materials using silver halide and dye-forming couplers that form yellow, cyan, and magenta dyes.

Each silver halide emulsion layer can be composed of one or more layers and the layers can be arranged in different locations with respect to one another. Typical arrangements are described in *Research Disclosure.*

The light sensitive silver halide emulsions can include coarse, regular or fine grain silver halide crystals of any shape or mixtures thereof and can be comprised of such silver halides as silver chloride, silver bromide, silver bromoiodide, silver chlorobromide, silver chloroiodide, silver chlorobromoiodide and mixtures thereof. The emulsions can be negative working or direct positive emulsions. They can form latent images predominantly on the surface of the silver halide grains or predominantly on the interior of the silver halide grains. They can be chemically or spectrally sensitized. The emulsions typically will be gelatin emulsions although other hydrophilic colloids as disclosed in *Research Disclosure* can be used in accordance with usual practice.

Exposed photographic elements containing coupler compounds of formulae (I), (IV), and (V) according to the invention are developed with an external aqueous solution in order to form a heat transferable dye image. By development with an external solution, activating or developer solutions of the ordinary type employed in the photofinishing trade are meant. Processing is generally done by immersing the element of the present invention into such external solutions. Such external solutions are specifically meant to exclude processing wherein the water needed for development or activation of dye-forming is provided by incorporated water of crystallization or by water incorporated by any means at the time of element manufacture. Such external solutions in the processes of the present invention include normal color developing solutions comprising aqueous solutions of color developing agents, such as aminophenols and paraphenylenediamines as described below. Such external solutions may also be of the aqueous activator type such as aqueous alkali solutions of alkaline pH or of aqueous peroxides or of other aqueous nucleophiles that activate color development of incorporated color developers or of incorporated blocked color developers. Incorporated color developers may be of any suitable type. Incorporated blocked color developers may be of any suitable type. Suitable blocked color developers are disclosed in U.S. Pat. Nos. 5,210,007 and 5,240,821 of Texter et al., the disclosures of which are incorporated herein by reference for all that they disclose about developers, blocked developers, the incorporation of developers and blocked developers in photographic elements, and the processing of elements containing incorporated developers and blocked developers. Preferred methods of incorporation of blocked developers are described in U.S. Pat. No. 5,256,525 of Southby et al., the disclosure of which is incorporated herein by reference for all that it discloses.

In principle, any combination of developer agent and polymeric coupler compound which forms a heat transferable dye upon development may be used. Selection of substituents for the polymeric coupler compounds of the invention as well as the developer agent will affect whether a heat transferable dye is formed upon development. Whether a particular coupler compound and developer agent combination generates a heat transferable dye suitable for use in the present invention will be readily ascertainable to one skilled in the art through routine experimentation.

Preferred color developing agents useful in the invention are p-phenylenediamines. Especially preferred are:

4-amino-N,N-diethylaniline hydrochloride;

4-amino-3-methyl-N,N-diethylaniline hydrochloride;

4-amino-3-methyl-N-ethyl-N-(p-methanesulfonamidoethyl)aniline sulfate hydrate;

4-amino-3-methyl-N-ethyl-N-(p-hydroxyethyl) aniline sulfate;

4-amino-3-(p-methanesulfonamido)ethyl-N,N-diethylaniline hydrochloride;

4-amino-3-methyl-N-ethyl-N-(p-methanesulfonamidoethyl)aniline sesquisulfate monohydrate; and 4-amino-3-methyl-N-ethyl-N-(2-methoxyethyl)aniline di-p-toluenesulfonic acid.

The aqueous development step is generally followed by washing step or steps, although such steps may be omitted with advantage in certain applications where compounds in the external developer/activating solution are not problematic in subsequent thermal dye transfer steps. This washing may include washing with an aqueous stop bath, and such a stop bath generally will be an acidic stop bath.

Bleaching, fixing, and blixing (combined bleaching-fixing) steps are generally omitted in preferred processes of the present invention. This omission serves to eliminate much of the aqueous pollution derived from conventional aqueous color processing. In particular applications, such as wherein it is desired to embed the formed dye image into the receiver layer in an integral element, according to Table 1, for the purpose of obtaining a particular hue effect imparted by the receiver polymer and transferred dyes and their interaction, or for the purpose of obtaining a particular stabilization imparted by such transfer, such as thermal stabilization against dark fade degradation, bleaching, fixing, and blixing steps may be retained in embodiments of the present invention.

The washing step or steps, or when omitted the developing step, and any blixing, bleaching, fixing step or steps, are followed by a drying step of some temporal duration, and preferably at temperatures less than 70° C. This drying step serves to remove excess water from the processed and aqueously developed donor element.

Photographic elements in which the photographic couplers of formula (I), (IV), and (V) are incorporated can be simple elements comprising a support and a single silver halide emulsion layer, or they can be multilayer, multicolor elements. The silver halide emulsion layer can contain, or have associated therewith, other photographic addenda conventionally contained in such layers.

The support can be of any suitable material used with photographic elements. Typically, a flexible support is employed, such as a polymeric film or paper support. Such supports include cellulose nitrate, cellulose acetate, polyvinyl acetal, poly(ethylene terephthalate), polycarbonate, white polyester (polyester with white pigment incorporated therein) and other resinous materials as well as glass, paper or metal. Paper supports can be acetylated or coated with baryta and/or an alpha-olefin polymer, particularly a polymer of an alpha-olefin containing 2 to 10 carbon atoms such as polyethylene, polypropylene or ethylene butene copolymers. The support may be any desired thickness, depending upon the desired end use of the element. In general, polymeric supports are usually from about 3 $\mu$m to about 200 $\mu$m and paper supports are generally from about 50 $\mu$m to about 1000 $\mu$m.

The dye receiving layer to which the formed dye image is transferred according to the process of the invention may be present as a coated or laminated layer between the support and silver halide emulsion layer(s) of the photographic element, or the photographic element support itself may function as the dye receiving layer. Alternatively, the dye receiving layer may be in a separate dye receiving element which is brought into contact with the photographic element before or during the dye transfer step. If present in a separate receiving element, the dye receiving layer may be coated or laminated to a support such as those described for the photographic element support above, or may be self-supporting. In a preferred embodiment of the invention, the dye-receiving layer is present between the support and silver halide emulsion layer of an integral photographic element.

The dye receiving layer may comprise any material effective at receiving the heat transferable dye image. Examples of suitable receiver materials include polycarbonates, polyurethanes, polyesters, polyvinyl chlorides, poly(styrene-co-acrylonitrile)s, poly (caprolactone)s and mixtures thereof. The dye receiving layer may be present in any amount which is effective for the intended purpose. In general, good results have been obtained at a concentration of from about 1 to about 10 g/m$^2$ when coated on a support. In a preferred embodiment of the invention, the dye receiving layer comprises a polycarbonate. The term polycarbonate as used herein means a polyester of carbonic acid and a glycol or a dihydric phenol. Examples of such glycols or dihydric phenols are paraxylene glycol, 2,2-bis(4-oxyphenyl)propane, bis(4-oxyphenyl) methane, 1,1-bis(4-oxyphenyl)ethane, 1,1-bis(oxyphenyl) butane, 1,1-bis(oxyphenyl)cyclohexane, 2,2-bis(oxyphenyl) butane, etc. In a particularly preferred embodiment, a bisphenol-A polycarbonate having a number average molecular weight of at least about 25,000 is used. Examples of preferred polycarbonates include General Electric LEXAN® Polycarbonate Resin and Bayer AG MACROLON 5700®. Further, a thermal dye transfer overcoat polymer as described in U.S. Pat. No. 4,775,657 may also be used. Heating times of from about 10 seconds to 30 minutes at temperatures of from about 50 to 200° C. (more preferably 75 to 160° C., and most preferably 80 to 120° C.) are preferably used to activate the thermal transfer process. This aspect makes it possible to use receiver polymers that have a relatively high glass transition temperature ($T_g$) (e.g., greater than 100° C.) and still effect good transfer, while minimizing back transfer of dye (diffusion of dye out of the receiver onto or into a contact material).

Stripping layers are included in preferred embodiments to facilitate the mechanical separation of receiver layers and mordant layers from donor layers and diffusible dye forming layers. Stripping layers are usually coated between a dye receiving layer and one or more diffusible dye-forming layers. Stripping layers may be formulated essentially with any material that is easily coatable, that will maintain dimensional integrity for a sufficient length of time so that a suitable image may be transferred by dye diffusion there through with sufficiently adequate density and sharpness, and that will facilitate the separation of donor and receiver components of the photographic element under suitable stripping conditions. Said dimensional stability must be maintained during storage and during the development and dye forming process. In preferred embodiments this dimensional stability is maintained during all wet or aqueous processing steps and during subsequent drying. Various stripping polymers and stripping agents may be used alone and in combination in order to achieve the desired strippability in particular processes with particular photographic elements. The desired strippability in a given process is that which results in clean separation between the image receiving layer(s) and the emulsion and diffusible dye forming layers adhering to the image receiving layer. Good results have in general been obtained with stripping agents coated at level of 3 mg/m$^2$ to about 500 mg/m$^2$. The particular amount to be employed will vary, of course, depending on the particular stripping agent employed and the particular photographic element used, and the particular process employed.

Perfluoronated stripping agents have been disclosed by Bishop et al. in U.S. Pat. No. 4,459,346, the disclosure of which is incorporated herein in its entirety by reference. In a preferred embodiment of our invention, the stripping layer comprises stripping agents of the following formula:

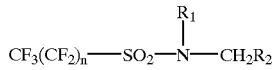

wherein $R_1$ is an alkyl or substituted alkyl group having from 1 to about 6 carbon atoms or an aryl or substituted aryl group having from about 6 to about 10 carbon atoms; $R_2$ is

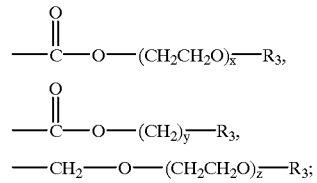

$R_3$ is H or $R_1$; n is an integer of from about 4 to about 19; x and y each represents an integer from about 2 to about 50, and z each represents an integer of from 1 to about 50. In another preferred embodiment, $R_1$ is ethyl, $R_2$ is

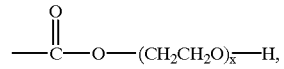

n is about 8, and x is about 25 to 50. In another preferred embodiment, $R_1$ is ethyl, $R_2$ is

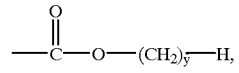

n is about 8, and y is about 25 to 50. In another preferred embodiment, $R_1$ is ethyl, $R_2$ is —$CH_2O(CH_2CH_2O)_zH$, n is 8 and z is 1 to about 30.

If the process of this invention is used to produce a transparency element for use in high magnification projection, it is desirable to maintain sharpness and to minimize the thickness of the diffusion path. This minimization is achieved in part by using a stripping layer that does not swell appreciably and which is as thin as possible. These requirements are met by the perfluoronated stripping agents herein described. These agents provide clean stripping and do not materially alter the surface properties at the stripping interface. These perfluoronated stripping agents also provide for a stripping layer with weak dry adhesion. A strong dry adhesion makes separation of substantially dry elements difficult. Preferred stripping agents useful in the process of this invention include Fluorad® FC-431, FC-432, and FC-170 of the 3M Company:

FC-431

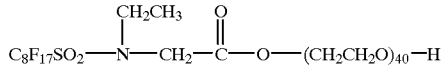

-continued

FC-432

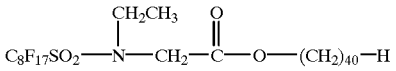

FC-170

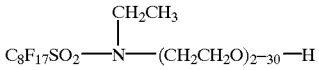

While essentially any heat source which provides sufficient heat to effect transfer of the developed dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of about 0.1 to 50 cm/sec are preferred to effect transfer at nip pressures of from about 500 Pa to about 1,000 kPa and nip temperatures of from about 75 to 190° C.

Thermal solvents may be added to any layer(s) of the photographic element (and separate receiving element) in order to facilitate transfer of the formed dye image from the emulsion layer to the dye receiving layer. Preferred thermal solvents are alkyl esters of 3-hydroxy benzoic acid and 4-hydroxy benzoic acid, which have been found to be particularly effective in facilitating dye transfer through dry gelatin as described in copending, commonly assigned U.S. application Ser. Nos. 7/804,868, filed Dec. 6, 1991, and Ser. No. 8/073,821, filed Jun. 8, 1993, of Bailey et al., the disclosures of which are incorporated by reference for all that they disclose about thermal solvents. Said thermal solvents are preferably incorporated in a given layer at a level of 1–300% by weight of the hydrophilic colloid incorporated in said layer.

After the dye image is transferred, the dye receiving layer may be separated from the emulsion layers of the photographic element by stripping one from the other. Automated stripping techniques applicable to the present invention are disclosed in U.S. Pat. No. 5,164,280 of Texter at al. and in copending, commonly assigned U.S. application Ser. No. 7/858,726, filed Mar. 27, 1992, of Lynch and Texter, now U.S. Pat. No. 5,294,514, the disclosures of which are incorporated by reference.

Further details regarding silver halide emulsions and elements, and addenda incorporated therein can be found in *Research Disclosure*, referred to above.

Photographic elements as described above are exposed in the process of the invention. Exposure is generally to actinic radiation, typically in the visible region of the spectrum, to form a latent image as described in *Research Disclosure* Section XVIII. The exposure step may also include exposure to radiation outside the visible region.

Aqueous alkaline dye-diffusion transfer during development or thereafter is well known in the art and is not mode of dye-diffusion transfer of the present invention. For example, Whitmore in Australian Patent Specification 261500 published May 2, 1973, and Whitmore and Mader in U.S. Pat. No. 3,227,550, disclose dye-diffusion transfer elements and image forming processes that utilize dyes that require aqueous alkaline diffusion transfer conditions. Such diffusing dyes are anionic during diffusion transfer, and typically require cationic mordants and dye-fixing layers. Such aqueous diffusion transfer is outside the scope of the elements and processes of the present invention. The receiving layer polymers of the present invention preferably do not comprise more than 5% by weight of cationic containing residues or repeating units.

Heat developable chromogenic photographic materials are widely disclosed in the art and include the disclosures of U.S. Pat. Nos. 4,536,467 and 4,555,470 of Sakaguchi et al., U.S. Pat. No. 4,584,267 of Masukawa and Koshizuka, U.S. Pat. No. 4,590,154 of Hirai et al., U.S. Pat. No. 4,770,989 of Komamura et al., and U.S. Pat. No. 4,891,304 of Nakamura. In these disclosures, incorporated herein for all they disclose about heat development, thermal development, and dye-diffusion transfer, heat development is done without external solutions. Such heat development is beyond the scope of the development processes of the present invention. Elements for such heat development usually contain incorporated silver salts in addition to catalytic amounts of silver halide. In preferred embodiments of the elements and processes of the present invention, such incorporated silver salts are omitted, since they generally would destroy the intended function of the elements of the present invention by unduly raising the silver ion activity during development.

The following examples illustrate the practice of this invention. They are not intended to be exhaustive of all possible variations of the invention. Parts and percentages are by weight unless otherwise indicated.

EXAMPLES

The following dye-forming and dye-releasing couplers were used in formulating the coatings of these examples:

C1

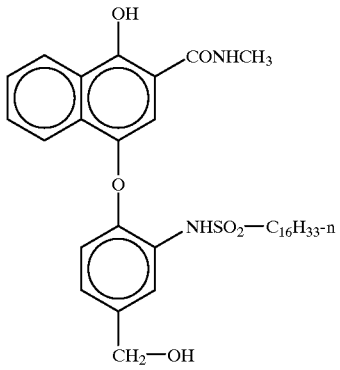

-continued

M1

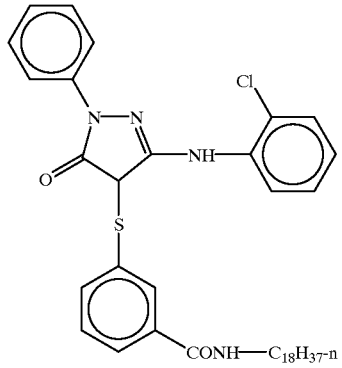

Y1

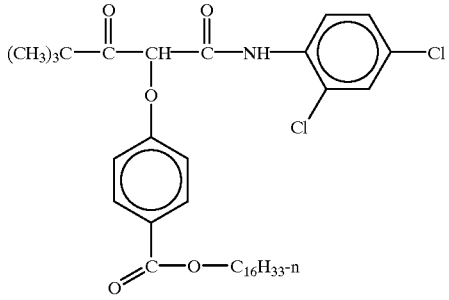

Y2

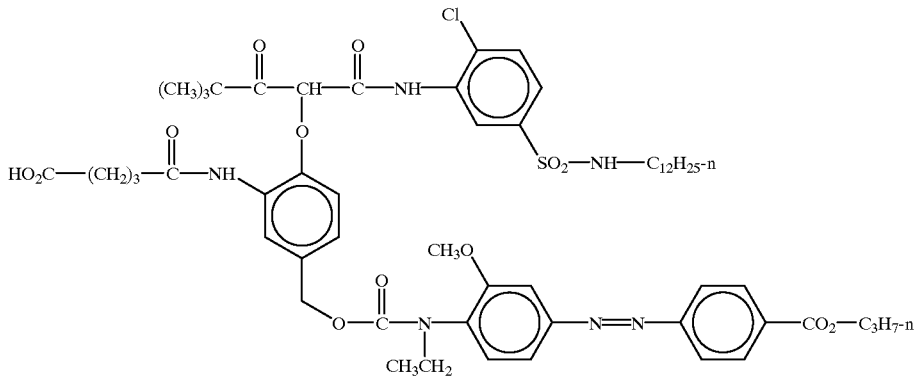

Couplers C1, M1, and Y1 were synthesized by methods well known in the art. Coupler Y2 was synthesized by methods described in copending, commonly assigned U.S. application Ser. No. 07/993,580 of Texter et al., filed Dec. 21, 1992, and incorporated herein by reference. The following thermal solvents were used in the coatings of these examples:

TS1

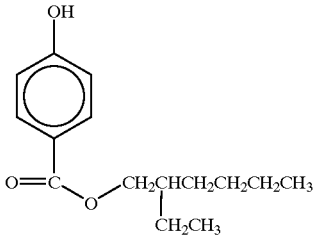

CAS Reg. No. 5153-25-3

-continued

TS2

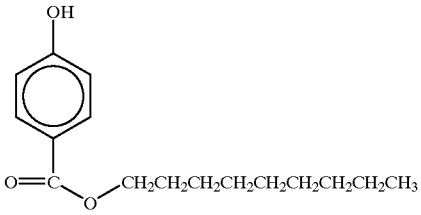

CAS Reg. No. 38713-56-3

These thermal solvents were obtained from Pfaltz & Bauer.

The test coatings of these examples had the multilayer structure illustrated in Table 1. The Support used in all of these coatings comprised a titania pigmented paper base. This base was resin coated with high density polyethylene, and coated with a Dyer-Receiving layer. The Imaging layer (s) was overcoated with a protective overcoat layer. The Overcoat layer contained gelatin at a coverage of about 1.07 g/m$^2$. Hardener, 1,1'-[methylene bis(sulfonyl)]bis-ethene

TABLE 3

| |
|---|
| Overcoat Layer |
| Gelatin (1.07 g/m$^2$) |
| Imaging Layer(s) |
| AgCl emulsion (0.64 g/m$^2$) |
| Dye-forming or Dye-releasing Coupler (2.69–3.22 g/m$^2$) |
| Thermal Solvent (0.8–1.1 g/m$^2$) |
| Gelatin (1.29–1.87 g/m$^2$) |
| Dye-Receiving Layer |
| Support |

(MBSE), was coated at a level corresponding to 1.5% by weight of the total gelatin coated. Deionized bone gelatin, Type IV, was used.

Examples 1 and 2

Two neutral example coatings were prepared with a single imaging layer, according to the format illustrated in Table 3. Blue-sensitized AgCl emulsion was coated at a coverage of about 644 mg/m$^2$ as silver.

Couplers C1, M1, and Y1 were coated, respectively, at coverages of about 806, 269, and 1610 mg/m$^2$. These three couplers were dispersed at these same weight ratios in a single dispersion by dissolving 4 g of C1, 2 g of M1, and 12 g of Y1 in 54 g ethylacetate, combining this solution with and aqueous gelatin/surfactant solution comprising 5.4 g of 10% (w/w) Alkanol-XC (Du Pont), 43.2 g of 12.5% (w/w) Type IV deionized bone gelatin, and 59.4 g of make-up water, and then forming a fine particle size colloidal dispersion by passing this mixture of solutions through a Gaulin colloid mill fine times, chill setting, noodling, washing to remove ethylacetate, remelting, and chill setting. The resulting dispersion was stored in the cold until used.

The thermal solvents TS1 (2'-ethylhexyl-4-hydroxy benzoate) and TS2 (nonyl-4-hydroxy benzoate) were coated in Example 1 and 2 coatings, respectively, at 806 mg/m$^2$. Aqueous gelatin dispersions of these thermal solvents were prepared similarly to the coupler dispersion described above, except that the ethylacetate dissolution and the washing steps were omitted for the TS1 dispersion. The TS1 dispersion was prepared by combining 17.4 g TS1 with an aqueous gelatin solution comprising 8.7 g of 10% (w/w) aqueous Alkanol-XC, 69.6 g of 12.5% (w/w) gelatin, and 194.3 g water, milling as described above with a colloid mill, chill setting, and storing until used for melt preparation. The TS2 dispersion was prepared by dissolving 9 g TS2 in 27 g ethylacetate, and combining this solution with an aqueous gelatin solution comprising 2.7 g of 10% (w/w) aqueous Alkanol-XC, 21.6 g of 12.5% (w/w) gelatin, and 29.7 g water, milling as described above with a colloid mill, chill setting, washing, remelting, chill setting, and storing. In the Example 1 coating with TS1, the total gelatin coated in the imaging layer was 1370 mg/m$^2$. The gelatin coated in the imaging layer of the TS2 coating of Example 2 was 1290 mg/m$^2$.

The dye-receiving layer comprised polycarbonate (PC) and polycaprolactam and was coated on the titania pigmented reflection paper base. This base was coated with a mixture of polycarbonate, polycapro-lactone, and 1,4-didecyloxy-2,5-dimethoxy benzene at a 0.77:0.115:0.115 weight ratio respectively, at a total coverage of 3.28 g/m$^2$. This polymeric dye-receiving layer was subjected to a corona discharge bombardment within 24 h prior to coating the imaging layers and overcoat layer of the example test elements.

Processing and Sensitometry

These test coatings were exposed for 0.1 s to a tungsten light source (2850° K) through a 0–3 density 21-step tablet and developed at 20° C. according to the following procedure. This process comprised development for 45 sec in a large volume of developer solution, a 60 sec stop in aqueous acetic acid, a 60 sec rinse in a pH 7 buffer, all at 20° C., washing in water for 300 sec at 40° C., and drying. The developer solution was prepared according to the following composition:

| | |
|---|---|
| Triethanolamine | 12.41 g |
| Phorwite REU (Mobay) | 2.3 g |
| Lithium polystyrene sulfonate (30% aqueous solution) | 0.30 g |
| N,N-diethylhydroxylamine (85% aqueous solution) | 5.40 g |
| Lithium sulfate | 2.70 g |
| KODAK Color Developing Agent CD-3 | 5.00 g |
| 1-Hydroxyethyl-1,1-diphosphonic acid (60% aqueous solution) | 1.16 g |
| Potassium carbonate, anhydrous | 21.16 g |
| Potassium bicarbonate | 2.79 g |
| Potassium chloride | 1.60 g |
| Potassium bromide | 7.00 mg |
| Water to make one liter | |
| pH 10.04 ± 0.05 at 80° F. | |

After drying, the overcoat and imaging (emulsion and dye-releasing) layers comprising the donor element were removed (stripped) from the receiving/base layers (receiver element) using the method described by Texter et al. in U.S. Pat. No. 5,164,280. The emulsion side of the dried and processed test coatings was contacted with the gel subbed (107 mg/m$^2$) side of an ESTAR adhesive element and passed 10 times at a rate of about 6 mm/s through pinch rollers heated to a surface temperature of 110° C. and held together under a pressure of 20 psi. The receiver elements were then pulled apart from the ESTAR adhesive element, and the donor layers were, thereby, stripped at the imaging layer/receiving layer interface and remained attached to the adhesive element. The donor layers contained undeveloped AgCl, the silver image, most of the unreacted coupler, and a small fraction of the image dye formed. The receiver elements, on the other hand, retained most of image dye formed during color development. Reflection dye densities in the Dmax and Dmin regions of the dye receiver elements were then read with a densitometer using status-A filters and are displayed in Table 4. Neutral tones were thereby obtained throughout the scale in both these examples.

TABLE 4

| | Reflection Red, Green, Blue, and Unit Neutral Densities | | | | | | |
|---|---|---|---|---|---|---|---|
| | Dmin | | | Dmax | | | |
| Coating | Red | Green | Blue | Red | Green | Blue | Unit Neutral |
| Example 1 (TS1) | 0.07 | 0.12 | 0.11 | 1.35 | 1.28 | 1.17 | 1.14 |
| Example 2 (TS2) | 0.06 | 0.11 | 0.10 | 1.32 | 1.27 | 1.10 | 1.12 |

Examples 3–6

Four example coatings were prepared to yield a cool, bluish hue, slightly off-neutral, using the same coating format described above for Examples 1 and 2. Examples 3, 4, and 5 used an equivalent amount of green-sensitized AgCl emulsion, and Example 6 utilized the same blue-sensitized emulsion, all coated at 644 mg/m$^2$.as silver.

The coolness to the hue was obtained by varying the coupler coverages. C1, M1, and Y1 were coated, respectively, at about 1070, 537, and 1610 mg/m$^2$. These three couplers were dispersed at these same weight ratios in a single dispersion by dissolving 20 g of C1, 10 g of M1, and 30 g of Y1 in 180 g ethylacetate, combining this solution with and aqueous gelatin/surfactant solution comprising 18 g of 10% (w/w) Alkanol-XC (Du Pont), 144 g of 12.5% (w/w) Type IV deionized bone gelatin, and 198 g of make-up water, and then forming a fine particle size colloidal dispersion by passing this mixture of solutions through a Gaulin colloid mill fine times, chill setting, noodling, washing to remove ethylacetate, remelting, and chill setting. The resulting dispersion was stored in the cold until used.

The same thermal solvent dispersions of TS1 and TS2 described earlier were used. TS1 was coated in Examples 3, 4, and 6 and TS2 was coated in Example 5, at 1070 mg/m$^2$ in each coating. In these coatings for Examples 3–6, the total gelatin coated in the imaging layer was 1870 mg/m$^2$.

The dye-receiving layer in the coatings of Examples 4, 5, and 6 was the same PC-type polycarbonate/polycaprolactam coated in Examples 1 and 2. Example 3 utilized a polyvinylalcohol (PVC) receiving layer, and was coated on the titania pigmented reflection paper base out of a tetrahydorfuran solution. These polymeric dye-receiving layers were subjected to a corona discharge bombardment within 24 h prior to coating the imaging layers and overcoat layer of the example test elements.

The processing and sensitometry evaluation were done identically as described above for Examples 1 and 2. Uniformly cool, bluish, off-neutral hues were obtained after dye transfer to the receiver and image separation of donor and receiver elements. The reflection Dmin and Dmax obtained in the final image area are illustrated in Table 5.

TABLE 5

| | Reflection Red, Green, Blue, and Unit Neutral Densities | | | | | | |
|---|---|---|---|---|---|---|---|
| | Dmin | | | Dmax | | | |
| Coating | Red | Green | Blue | Red | Green | Blue | Unit Neutral |
| Example 3 (TS1/PVC) | 0.08 | 0.14 | 0.10 | 1.56 | 1.40 | 0.80 | 1.29 |
| Example 4 (TS1/PC) | 0.08 | 0.14 | 0.15 | 1.68 | 1.50 | 0.91 | 1.39 |
| Example 5 (TS2/PC) | 0.07 | 0.14 | 0.15 | 1.51 | 1.32 | 0.81 | 1.23 |
| Example 6 (TS1/PC) | 0.08 | 0.13 | 0.15 | 1.43 | 1.38 | 0.90 | 1.22 |

Examples 7 and 8

Two examples were prepared to yield a warm, sepia hue, slightly off-neutral, using the same base, receiving layer, and overcoat described in the coating format above for Examples 1 and 2. These examples utilized a single coating, processed in different developers. The coating format utilized a two-layer imaging layer format. The first imaging layer coated directly upon the receiver layer comprised cyan dye-forming coupler C1 and yellow dye-releasing coupler Y2. The second imaging layer comprised magenta dye-forming coupler M1. Component coverages are illustrated in Table 6.

The couplers C1 and Y2 were incorporated in the first imaging layer in a single dispersion that also contained TS1. This dispersion was formulated by dissolving 3.3 g C1, 3.3 g Y2, and 4.9 g TS1 in 23 g of ethylacetate. This solution was then emulsified with an aqueous gelatin solution comprising 4.6 g 10% (w/w) Alkanol-XC, 27.6 g 12.5% (w/w) gelatin, and 48.3 g of additional water by passing the mixture through a colloid mill five times, chill setting, and storing in the cold until used for coating melt preparation. The ethylacetate was not removed by washing, but was removed by evaporation after coating. A separate dispersion of M2 was prepared for the second imaging layer by dissolving 8 g of M2 in 24 g of ethylacetate and emulsifying this solution with aqueous gelatin comprising 3.2 g 10% (w/w) Alkanol-XC, 19.2 g 12.5% (w/w) gelatin, and 25.6 g of additional water by passing the mixture through a colloid mill five times, chill setting, noodling, washing to remove ethylacetate, remelting, chilling, and storing in the cold until used for coating melt preparation. TS1 was incorporated into the second imaging layer by using a TS1 dispersion prepared similarly to the TS1 dispersion described above for Example 1.

These test coatings were exposed for 0.01 s to a tungsten light source (2850° K) through a 0–3 density 21-step tablet and developed at 35° C. according to the following procedure. Identically exposed coatings were processed developed for 45 sec and then differently treated (1) for dye transfer and heat image separation and (2) for dye-image reference calibration (no heated dye-transfer). The coatings processed (1) for dye transfer and heat image separation were then subjected to a 60 sec stop in aqueous acetic acid, a 60 sec rinse in pH 7 buffer, and a 300 sec wash in water, all at 35° C. After drying, dye transfer and heat image separation was achieved as described above for Examples 1 and 2. The coatings processed (2) for dye-image reference calibration (no heated dye-transfer) were immersed in a bleach-fix solution for 45 sec, and water wash for 90 sec, all at 35° C., and then dried. Reflection densitometry of these coatings yielded red, green, and blue dye densities of the total dye produced, before thermal dye transfer, and serves as a reference by which the thermal dye-transfer coefficients can be obtained.

TABLE 6

| Coating Format for Examples 7 and 8 |
|---|
| Overcoat Layer |
| Gelatin (1.07 g/m$^2$) |
| Imaging Layer 1 |
| Blue-Sensitized AgCl emulsion (0.41 g/m$^2$) |
| M1 (0.69 g/m$^2$) |
| TS1 (0.86 g/m$^2$) |
| Gelatin (0.64 g/m$^2$) |
| Imaging Layer 2 |
| Blue-Sensitized AgCl emulsion (0.64 g/m$^2$) |
| C1 (1.07 g/m$^2$); Y2 (1.07 g/m$^2$) |
| TS1 (1.61 g/m$^2$) |
| Gelatin (1.61 g/m$^2$) |
| Dye-Receiving Layer |
| Support |

Example 7 was generated by using the same developer solution described above in Examples 1 and 2. Example 8 was generated by substituting 3.35 g/L of KODAK Color Developing Agent CD-4 for the CD-3 used in Example 7.

The resulting reflection densities are illustrated in Table 7. Dmin and Dmax are illustrated for each example before dye-transfer (bleached and fixed coatings; no thermal dye-transfer) and for the receiver after dye transfer. A rich sepia toned image was obtained for both examples.

Dye-density transfer coefficients computed from the Dmax data of Table 7 are illustrated in Table 8, and are computed from the relation derived from Eqn. (2):

$$T = \frac{(D_{\max})_{Receiver}}{(D_{\max})_{Before\ Dye\ Transfer}} \quad \text{Eqn. (4)}$$

These coefficients are uncorrected for residual absorption of the respective couplers in the coatings evaluated before dye-transfer and after dye-transfer. The blue transfer coefficients appear largest for these combinations of couplers, coating format, developers, and development processes. The green transfer coefficients are next largest, which is noteworthy since the magenta dye formation occurs in the second imaging layer and the magenta dye has a significantly longer diffusion path to the receiver.

TABLE 7

| | Reflection Red, Green, Blue, and Unit Neutral Densities | | | | | | |
|---|---|---|---|---|---|---|---|
| | Dmin | | | Dmax | | | |
| Coating | Red | Green | Blue | Red | Green | Blue | Unit Neutral |
| Example 7 (CD-3) Image in Receiver | 0.08 | 0.14 | 0.21 | 1.75 | 1.99 | 1.91 | 1.62 |
| Example 7 (CD-3) Image before dye-transfer | 0.23 | 0.77 | 0.83 | 3.16 | 3.23 | 3.03 | 3.12 |
| Example 8 (CD-4) Image in Receiver | 0.09 | 0.18 | 0.22 | 1.70 | 2.13 | 2.03 | 1.73 |
| Example 8 (CD-4) Image before dye-transfer | 0.19 | 0.58 | 0.81 | 3.13 | 3.34 | 2.93 | 3.09 |

TABLE 8

| | Transfer Coefficients Derived from Red, Green, Blue, and Unit Neutral Dmax | | | |
|---|---|---|---|---|
| | $T_{Red}$ | $T_{Green}$ | $T_{Blue}$ | $T_{Unit\text{-}Neutral}$ |
| Example 7 (CD-3) | 0.55 | 0.62 | 0.63 | 0.52 |
| Example 8 (CD-4) | 0.54 | 0.64 | 0.69 | 0.56 |

The invention has been described in detail with particular reference to preferred embodiments thereof, but it will be understood that variations and modifications can be effected within the spirit and scope of the invention.

What we claim is:

1. An aqueous developable photographic element for forming neutral images comprising balanced cyan, magenta, and yellow heat-diffusible-dye-forming couplers in one or more image forming layers, and further comprising sensitized silver halide, a thermal solvent for nonaqueous, thermal dye-diffusion transfer, and hydrophilic binder, each independently in one or more image forming layers, an integral receiver layer for dye mordanting during nonaqueous, dimensionally stable support, where said receiver layer is intermediate said support and image forming layers, wherein said receiver layer and said support may be mechanically separated from said image forming layers by opposing forces, and wherein heat-diffusible-dye obtained from said heat-diffusible-dye forming couplers is substantially insoluble and nondiffusible in aqueous medium of pH 7 to 13, and wherein said balanced cyan, magenta, and yellow heat-diffusible-dye-forming couplers and said sensitized silver halide are balanced in a manner which provides a neutral image.

2. A chromogenic diffusion transfer process for forming a neutral photographic image comprising the steps of:

providing an aqueous developable photographic element for forming neutral images comprising balanced cyan, magenta, and yellow heat-diffusible-dye-forming couplers in one or more image forming layers, and further comprising sensitized silver halide, a thermal solvent for nonaqueous, thermal dye-diffusion transfer, and hydrophilic binder, each independently in one or more image forming layers, an integral receiver layer for dye mordanting during nonaqueous, thermal dye-diffusion transfer, and one and only one dimensionally stable support, where said receiver layer is intermediate said support and image forming layers, wherein said receiver layer and said support may be mechanically separated from said image forming layers by opposing forces, and wherein heat-diffusible-dye obtained from said heat-diffusible-dye forming couplers is substantially insoluble and nondiffusible in aqueous medium of pH 7 to 13;

exposing said element to actinic radiation;

processing said element by contacting said element to an external aqueous bath containing compounds selected from the group consisting essentially of color developer compounds of the primary amine type, compounds which activate the release of incorporated color developers, and compounds which activate development by incorporated developers;

washing said element;

drying said element to remove imbibed water;

heating said element to effect dye-diffusion transfer to said integral receiver layer; and separating said integral receiver layer from said image forming layers, wherein bleaching and fixing steps are excluded from said chromogenic diffusion transfer process.

3. A chromogenic diffusion transfer process for forming a neutral photographic image comprising the steps of:

providing an aqueous developable photographic element for forming neutral images comprising balanced cyan, magenta, and yellow heat-diffusible-dye-forming couplers in one or more image forming layers, and further comprising sensitized silver halide, a thermal solvent for nonaqueous, thermal dye-diffusion transfer, and hydrophilic binder, each of said thermal solvent and hydrophilic binder is independently in one or more image forming layers, and one and only one support, and wherein heat-diffusible-dye obtained from said heat-diffusible-dye forming couplers is substantially insoluble and nondiffusible in aqueous medium of pH 7 to 13;

exposing said element to actinic radiation;

processing said element by contacting said element to an external aqueous bath containing compounds selected from the group consisting essentially of color developer compounds of the primary amine type, compounds which activate the release of incorporated color developers, and compounds which activate development by incorporated developers;

washing said element;

drying said element to remove imbibed water;

contacting said image forming layers of said photographic element with a dry image receiving element comprising an image receiving layer for dye mordanting during nonaqueous, thermal dye-diffusion transfer such that said image forming and image receiving layers are in reactive association with respect to thermally activated dye diffusion transfer, and one and only one dimensionally stable support;

heating said contacting photographic and receiving elements to effect dye-diffusion transfer to said image receiving layer; and separating said receiving element from said aqueous developable photographic element, wherein bleaching and fixing steps are excluded from said chromogenic diffusion transfer process.

4. The element of claim 1 or the method of claims 2 or 3, wherein said radiation sensitive silver halide comprises at least one of blue sensitized silver halide grains and green sensitized silver halide grains.

5. The element of claim 1 or the method of claims 2 or 3, wherein said photographic element comprises at least two layers, one layer comprising blue sensitized silver halide and one layer comprising green sensitized silver halide grains, and each layer further comprising balanced cyan, magenta, and yellow heat-diffusible-dye-forming couplers.

6. The element and methods of claim 5, wherein said photographic element further comprises a layer comprising red sensitized silver halide grains and balanced cyan, magenta, and yellow heat-diffusible-dye-forming couplers.

7. The element of claim 1 or the method of claims 2 or 3, wherein said photographic element comprises a layer comprising blue sensitized and green sensitized silver halide grains, and balanced cyan, magenta, and yellow heat-diffusible-dye-forming couplers.

8. The element and methods of claim 7, wherein said layer comprising blue sensitized and green sensitized silver halide grains further comprises red sensitized silver halide grains.

9. The element of claim 1 or the method of claims 2 or 3, wherein said photographic element forms a black and white neutral image when developed.

10. The element of claim 1 or the method of claims 2 or 3, wherein said sensitized silver halide comprises red sensitized silver halide, green sensitized silver halide, and blue sensitized silver halide, and further wherein said sensitized silver halide is coated in ratios corresponding to diffusion-transfer-convoluted eye-response.

11. The element of claim 1 or the method of claims 2 or 3, wherein said dimensionally stable support comprises a highly reflecting photographic paper base.

12. The element of claim 1 or the method of claims 2 or 3, wherein said dimensionally stable support comprises a transparent film base.

13. The element of claim 1 or the method of claims 2 or 3, wherein said silver halide is selected from the group consisting essentially of silver chloride, silver chlorobromide, silver bromide, silver bromoiodide, and silver chlorobromoiodide.

14. The element of claim 1 or the method of claims 2 or 3, wherein said balanced cyan, magenta, and yellow heat-diffusible-dye-forming couplers are neutrally balanced.

15. The element of claim 1 or the method of claims 2 or 3, wherein said thermal solvent is selected from the group consisting essentially of 3-hydroxy benzoic acid esters and 4-hydroxy benzoic acid esters.

16. The element of claim 1 or the method of claim 2, wherein said photographic element further comprises a stripping layer intermediate said receiving layer and said image forming layers.

17. The element of claim 1 or the method of claims 2 or 3, wherein said couplers are selected from the group consisting essentially of non-polymeric heat-diffusible-dye-forming couplers ballasted at the coupling position, heat-diffusible-dye-forming polymeric couplers, and heat-diffusible-dye-releasing couplers.

18. The method of claims 2 or 3, further comprising the step of contacting said element with an external stop bath intermediate said processing and washing steps.

19. The method of claim 18, wherein said stop bath is an acidic aqueous bath.

20. The method of claims 2 or 3, wherein said drying step excludes heating to more than 70° C.

21. The method of claims 2 or 3, wherein said heating step comprises heating said photographic element to a temperature of from 75° C. to 160° C. for from 10 seconds to 30 minutes.

22. The method of claims 2 or 3, wherein said heating step comprises running said photographic element through rollers at a pressure of 500 Pa to 1,000 kPa, and at a speed of 0.1 cm/s to 50 cm/s.

23. The method of claims 2 or 3, wherein the temperature in said heating step is adjusted to obtain a given contrast in the transferred image.

24. The method of claims 2 or 3, wherein the temporal duration of heating in said heating step is adjusted to obtain a given contrast in the transferred image.

* * * * *